US010390665B1

(12) United States Patent
Lewis et al.

(10) Patent No.: US 10,390,665 B1
(45) Date of Patent: Aug. 27, 2019

(54) TOILET SEAT WITH WINGS AND STABILIZING MEMBERS

(71) Applicants: Aaron H. Lewis, Hacienda Heights, CA (US); Douglas K. Dungee, Las Vegas, NV (US)

(72) Inventors: Aaron H. Lewis, Hacienda Heights, CA (US); Douglas K. Dungee, Las Vegas, NV (US)

(73) Assignee: COMFORT PLUS LLC, Las Vegas, NV (US)

( * ) Notice: Subject to any disclaimer, the term of this patent is extended or adjusted under 35 U.S.C. 154(b) by 0 days.

(21) Appl. No.: 15/714,733

(22) Filed: Sep. 25, 2017

Related U.S. Application Data

(60) Provisional application No. 62/460,859, filed on Feb. 19, 2017.

(51) Int. Cl.
*A47K 13/10* (2006.01)
*A47K 13/02* (2006.01)

(52) U.S. Cl.
CPC ..... *A47K 13/105* (2013.01); *A47K 13/02* (2013.01)

(58) Field of Classification Search
CPC .... A47C 3/12; A47C 5/12; A47C 7/16; A47K 13/00; A47K 13/005; A47K 13/02; A47K 13/04; A47K 13/105; A47K 13/24
USPC ..... 4/234, 237, 239, 241, 420
See application file for complete search history.

(56) References Cited

U.S. PATENT DOCUMENTS

| | | | | | |
|---|---|---|---|---|---|
| 1,588,019 | A * | 6/1926 | Gitter | A47K 13/00 | 4/237 |
| 2,493,362 | A * | 1/1950 | Rocker | A47K 13/02 | 4/234 |
| 2,539,481 | A * | 1/1951 | Rosenheim | A47K 13/12 | 4/237 |
| 3,786,522 | A * | 1/1974 | Kira | A47K 13/00 | 4/237 |
| 4,233,696 | A * | 11/1980 | Ibel | A47K 13/00 | 4/234 |
| 4,843,656 | A | 7/1989 | Forman | | |
| D352,103 | S | 11/1994 | Walden, Jr. | | |
| D377,251 | S | 1/1997 | Hillhouse, Jr. | | |
| D421,491 | S | 3/2000 | Hewitt | | |
| D473,296 | S | 4/2003 | Tucci | | |
| D672,855 | S | 6/2012 | Lewis | | |
| D672,443 | S | 12/2012 | Cowen | | |
| 2005/0022294 | A1 | 2/2005 | Garza et al. | | |
| 2005/0177932 | A1 | 8/2005 | Hilton | | |

(Continued)

FOREIGN PATENT DOCUMENTS

| | | | | |
|---|---|---|---|---|
| WO | WO2005011552 | * 2/2005 | E03D 11/02 | |
| WO | WO2012009488 | * 1/2012 | A47K 13/00 | |

*Primary Examiner* — David Angwin
*Assistant Examiner* — Nicholas Ros
(74) *Attorney, Agent, or Firm* — Ming Chow; Sinorica, LLC

(57) ABSTRACT

A commercial toilet seat for use in public facilities for adults where the improved toilet seat has a stabilizing base section which conforms to the upper rim of a toilet for stability when people, especially large adult people, sit on a toilet. The toilet seat provides a greater surface area of contact between the toilet seat and the rim of the toilet and a greater surface area to sit on. The toilet seat also has downwardly slopping wings that extend from each side of the toilet seat which allow the user to more easily lift the toilet seat.

16 Claims, 7 Drawing Sheets

(56) References Cited

U.S. PATENT DOCUMENTS

| | | | | |
|---|---|---|---|---|
| 2006/0156459 | A1 | 7/2006 | Hsu | |
| 2016/0029860 | A1* | 2/2016 | Pordy | A47K 13/00 4/237 |

* cited by examiner

TOILET SEAT WITH WINGS AND STABILIZING MEMBERS

CROSS-REFERENCE TO RELATED APPLICATION

This patent application claims priority to Provisional Application No. 62/460,859 filed on Feb. 19, 2017.

BACKGROUND OF THE INVENTION

1. Field of the Invention

The present invention relates to the field of commercial toilet seats. Specifically, the present invention relates to an improved commercial toilet seat for adults, including large bodied and obese people.

2. Description of the Prior Art

Aaron Lewis, one of the co-inventors of the present invention, is also the sole inventor of issued U.S. Design Pat. D672,855 issued on Jun. 19, 2012 for "Winged Commercial Toilet Seat". Co-inventors Aaron Lewis and Douglas Dungee have made significant improvements to the invention protected by the prior issued design patent, which improvements are the subject of this provisional patent application.

Based upon a prior art search, the present inventors are also aware of the following prior art patents and published patent applications:

1. U.S. Pat. No. 4,843,656 issued to Brian Forman on Jul. 4, 1989 for "One Piece Toilet Seat with Lifting Feature" (hereafter the "Forman Patent");
2. U.S. Design Pat. No. Des. 352,103 issued to Gary L. Waldren, Jr. on Nov. 1, 1994 for "Toilet Seat" (hereafter the "Waldren Design Patent");
3. U.S. Design Pat. No. Des. 377,251 issued to Danny E. Hillhouse, Jr. on Jan. 21, 1997 for "Toilet Seat" (hereafter the "Hillhouse Design Patent");
4. U.S. Design Pat. No. Des. 421,491 issued to Laura Hewitt on Mar. 7, 2000 for "Handle Toilet Seat" (hereafter the "Hewitt Design Patent");
5. U.S. Design Pat. No. D473,296 issued to Vincent Tucci on Apr. 15, 2003 for "Toilet Seat Having Lift Grip Molded Therein" (hereafter the Tucci Design Patent");
6. United States Published Patent Application No. 2005/0022294 to Javier Garza Laguera Garza et al. on Feb. 3, 2005 for "Toilet for Obese Persons" (hereafter the "Garza Published Patent Application");
7. United States Published Patent Application No. 2005/0177932 to Lin Berlitz Hilton on Aug. 18, 2005 for "Toilet Seat" (hereafter the "Hilton Published Patent Application");
8. United States Published Patent Application No. 2006/0156459 to Richard Hsu on Jul. 20, 2006 for "Toilet Bowl Seat" (hereafter the "Hsu Published Patent Application");
9. U.S. Design Pat. No. D672,443 issued to Stephen Roy Cowen on Dec. 11, 2012 for "Toilet Seat" (hereafter the "Cowen Design Patent").

The Forman Patent discloses a one piece toilet seat comprising a rim having a central opening. The toilet seat rim has a front and back section. There is an imaginary axis passing through the front and back sections of the toilet seat rim. This axis lies generally perpendicular to the plane of the person using the toilet seat. The toilet seat rim includes a lifting tab which extends outwardly from the rim, preferably at an acute angle relative to the rim. In this way, the toilet seat rim may be raised and lowered by grasping the tabs.

The Waldren Design Patent is different from the present invention.

The Hillhouse Design Patent discloses the ornamental shape for a toilet seat but the overall shape of the Hillhouse Design Patent is different in that the Hillhouse patent is shaped more similar to a heart shape and does not have the unique patentable elements of the present invention.

The Hewitt Design Patent discloses a handle toilet seat where the handle includes a cutout for finger insertion. The invention of this design patent is totally different from the present invention.

The Tucci Design Patent discloses the ornamental shape for a toilet seat that has wings that extend from the sides, but in a different fashion than in the present invention. The wings from the Tucci patent are semi-circular in shape as they extend outwardly over the edge of the toilet seat.

The Gaza Published Patent Application discloses a toilet apparatus designed for use by obese persons, the toilet comprising a base portion having a width of about 21.5 inches and a length of about 29.05 inches, a bowl portion attached to the base portion wherein the width of the outer portion of the bowl is about 25 inches, the length of the outer portion of the bowl is about 32 inches, and wherein the outer portion of the bowl is substantially aligned with a bottom of the base portion, and a toilet seat comprising an inner and an outer rim and further comprising two vertically extending rigid members located between the outer and inner rims of the left side and the right side of the toilet seat. The vertically extending rigid members are positioned for alignment with an interior edge of a toilet bowl as to prevent lateral displacement of the seat when in use.

The Hilton Published Patent Application discloses a toilet seat adapted to be pivotally mounted on a toilet bowl and is specially configured for a person with large buttocks, disabled persons or children. The toilet seat includes a generally planar seat plate, and oval hole in the plate's central region. The plate is adapted to be pivotally mounted to the toilet bowl. Side extensions laterally extend from the seat plate. Each side extension has a lateral outboard end region disposed at an acute angle upwards from the generally planar seat. Each side extension includes a cut-out forming a handle for the person.

The HS Published Patent Application discloses a toilet bowl seat respectively having an outwardly extending wing on both sides to provide more areas in helping support the bottom of an overweight user to provide better sitting comfort. This invention discloses multiple supports (13) that are used to support the toilet seat on the rim of the toilet only at specific locations.

The Cowen Design Patent discloses the ornamental shape for a toilet seat that has wings that extend from the sides, but in a much wider fashion than in the present invention. The wings of the Cowen Design Patent are pentagonal-shaped as they extend outwardly over the edge of the toilet seat. The Cowed Design Patent also is different in that Cowen Design Patent has a completely different bottom shape than the present invention.

There is a significant need for a toilet seat that is specifically designed to support large adult people by having a greater surface area of contact on the upper rim of the toilet seat and which will provide adequate stability to support a large adult person.

SUMMARY OF THE INVENTION

The present invention is an improved commercial toilet seat for adults, including large adults and obese people. The present invention improved toilet seat has a stabilizing base section which conforms to the upper rim of a toilet bowl to provide stability when people, especially large adult people, sit on a toilet seat. The present invention commercial toilet seat is an improvement over prior toilet seats by providing a greater surface area of contact between the toilet seat and the rim of the toilet bowl. The present invention also has downwardly sloping wings that extend from each side of the toilet seat which allow the user to more easily lift the toilet seat.

The additional surface area of contact with the rim of the toilet bowl is created from the shape of the bottom of the toilet seat that has a flat section that corresponds to the shape of the rim of a toilet bowl and has a horizontal section which is in direct contact with the rim of the toilet bowl which allows greater stability.

The present invention has a horizontal section that is generally arcuate in shape with a gap in the front section, and primarily formed from a first interior partial circumferential wall having a first partial circumference and a second interior second partial circumferential wall having a second partial circumference, the second partial circumference larger than the first partial circumference. A multiplicity of spaced apart horizontal transverse strengthening ribs extend from the first interior partial circumferential wall to the second interior partial circumferential wall and for a radial distance radially away from the second interior partial circumferential wall. Together, these two interior partial circumferential walls and multiplicity of horizontal strengthening ribs form a horizontal flat surface that rests directly on the upper rim of the toilet bowl.

For additional support and stability, the bottom of the commercial toilet seat also has a multiplicity of sloped transverse ribs which extend from the respective locations where the horizontal strengthening ribs end and continue at an upwardly sloped angle until reaching an exterior circumferential wall aligned with the exterior circumference of the commercial toilet seat. The thickness of the commercial toilet seat enables the corresponding upper surface of the commercial toilet seat to extend to a sloped semi-bowl shaped area from the interior arcuate opening and first interior partial circumferential wall to the exterior partial circumferential wall.

Each respective spaced apart transverse strengthening rib is an individual rib initially set in a horizontal direction and then extending at an upwardly sloped angle. Each transverse strengthening rib has a varied vertical height with the portion of the transverse strengthening ribs located at the inner circumferential edge adjacent to the arcuate central opening having a greater vertical height than the portion of transverse strengthening ribs adjacent to the exterior circumference.

The object of the present invention is to create a commercial toilet seat having a bottom portion including a first stabilizing section which rests upon the upper rim of a toilet bowl and an upwardly sloped transverse rib supporting section supporting the portion of the commercial toilet seat extending outwardly from the top rim of the toilet bowl, and a top portion having a sloped semi-bowl shaped top surface extending from the central opening to above the exterior circumferential wall, the outermost sloped and semi-bowl shaped area extending above and outwardly from the top rim of the toilet bowl and adapted to support the size and weight of adults, including large and obese adults.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
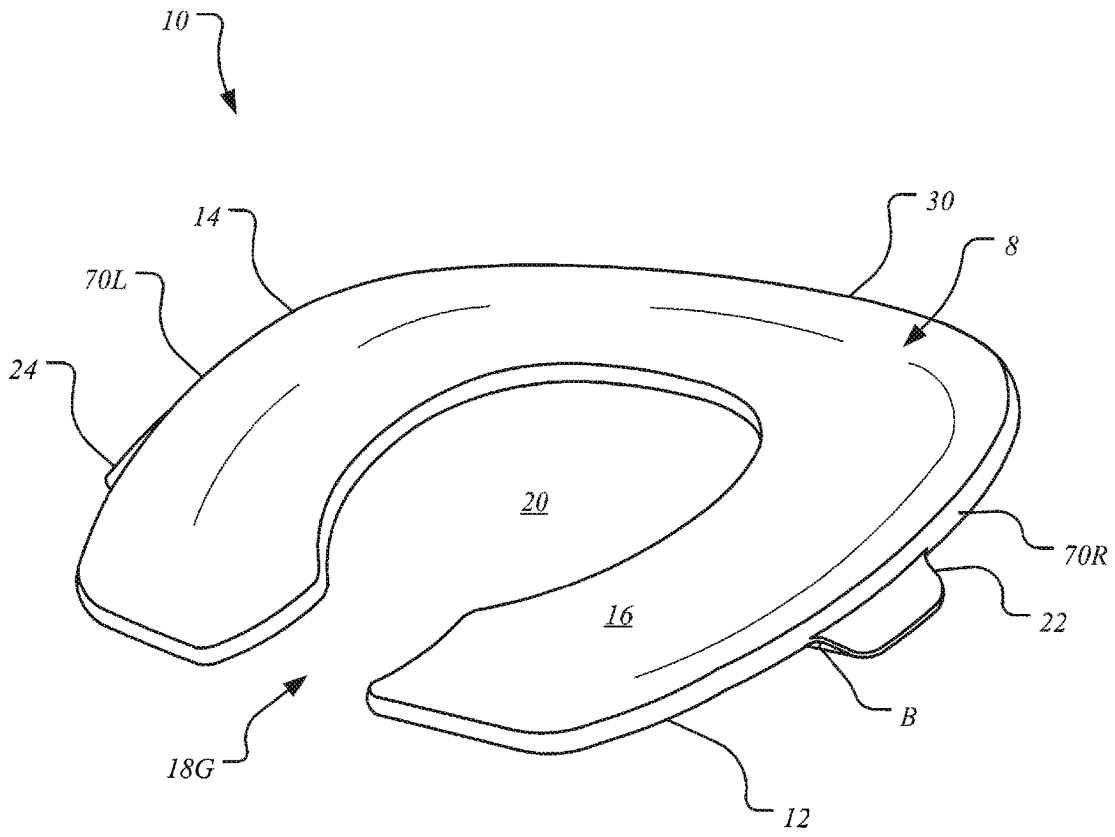
FIG. 1 is a front top perspective view of the commercial toilet seat with wings and stabilizing members.

Referring to FIG. 1, there is illustrated a front top perspective view of the commercial toilet seat 10 with wings and stabilizing members for commercial use. Commercial toilet seat as discussed in this patent application refers to toilet seats in a public restroom such as an office, recreational venue such as a zoo or amusement park, and any other facility where toilets are publicly used. Toilets in dwellings such as a hotel room may be either commercial or residential toilets. Commercial toilet seat 10 has a top portion 8 having a sloped semi-bowl shaped top surface 16 and an open arcuate area 20 that is partially surrounded by a commercial toilet seat left section 14 and a commercial toilet seat right section 12. The commercial toilet seat left section 14 has a left wing 24 and commercial toilet seat right section 12 has a right wing 22. The commercial toilet seat left section 14 and the commercial toilet seat right section 12 are mirror images of each other and form opposite sides of a front gap 18G. Opposite the commercial toilet seat front gap 18G, the commercial toilet seat left section 14 and the commercial toilet seat right section 12 meet at a commercial toilet seat rear section 30. While described in sections, the commercial toilet seat is formed in one piece.

Figure 2A:
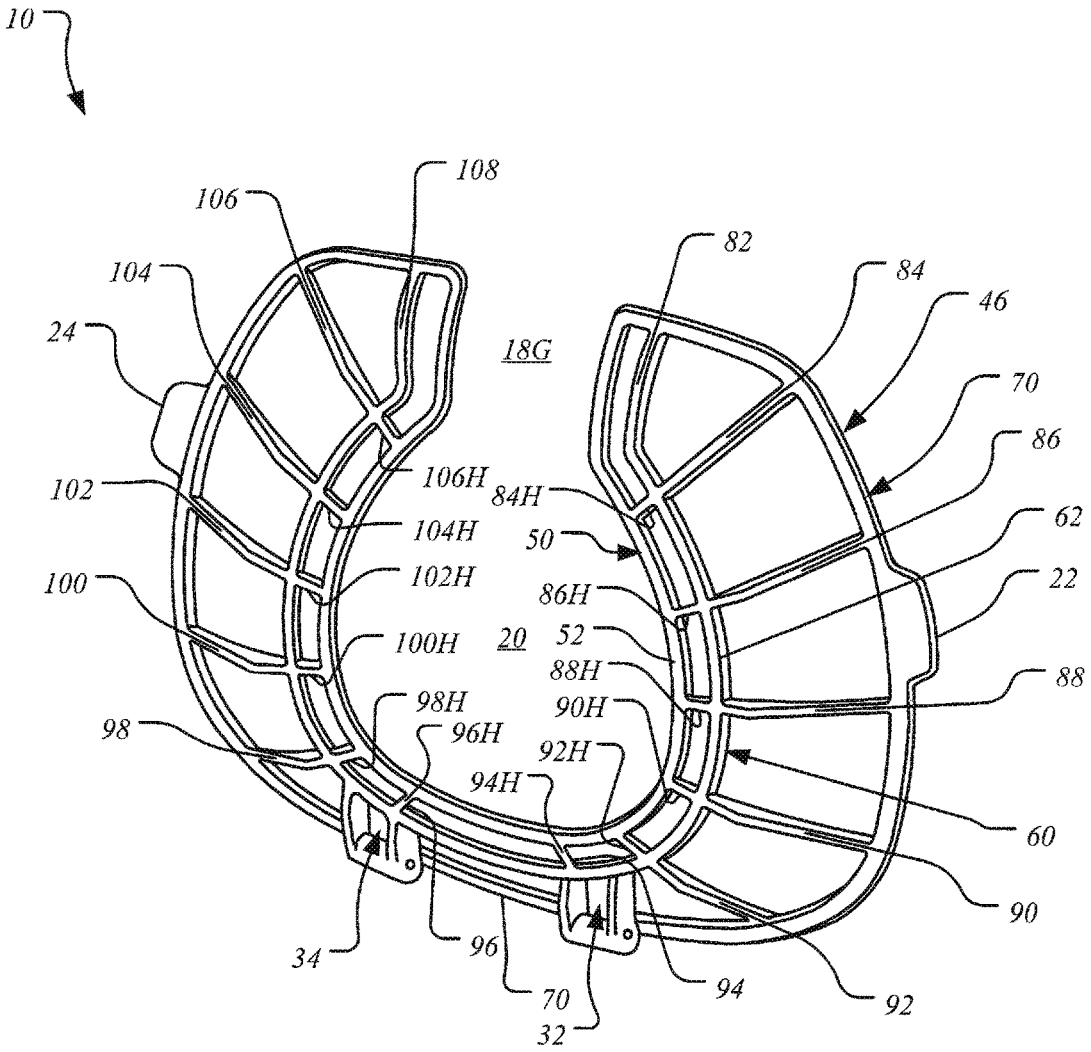
FIG. 2A is a bottom perspective view of the commercial toilet seat with wings and stabilizing members illustrating the two interior partial circumferential walls that form the horizontal section that rests directly on the upper rim of the toilet bowl and the multiplicity of spaced apart stabilizing ribs that intersect the two interior partial circumferential walls and extend in a horizontal direction past the outermost interior partial circumferential wall and then extend at an upward slope until the multiplicity of stabilizing ribs join the exterior partial circumferential wall with respective wings extending at a downward slope on opposite sides of the exterior partial circumferential wall.
Figure 2B:
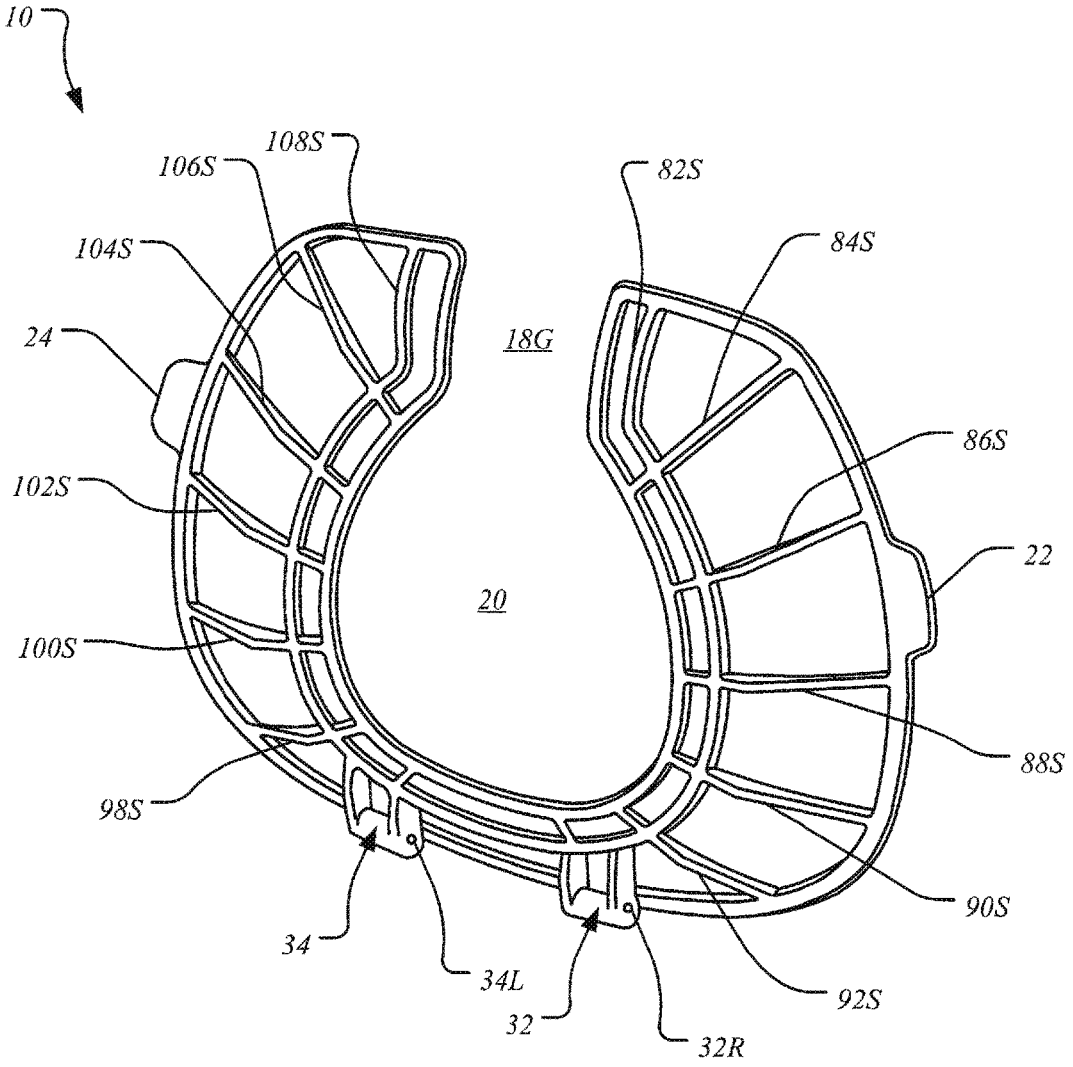
FIG. 2B is identical to FIG. 2A and is a bottom perspective view of the commercial toilet seat with wings and stabilizing members illustrating the two interior partial circumferential walls that form the horizontal section that rests directly on the upper rim of the toilet bowl and the multiplicity of spaced apart stabilizing ribs that intersect the two interior partial circumferential walls and extend in a horizontal direction past the outermost interior partial circumferential wall and then extend at an upward slope until the multiplicity of stabilizing ribs join the exterior partial circumferential wall with respective wings extending at a downward slope on opposite sides of the exterior partial circumferential wall, FIG. 2A and FIG. 2B drawn in duplicate to facilitate clear lead line and numbering of the parts.
Figure 3:
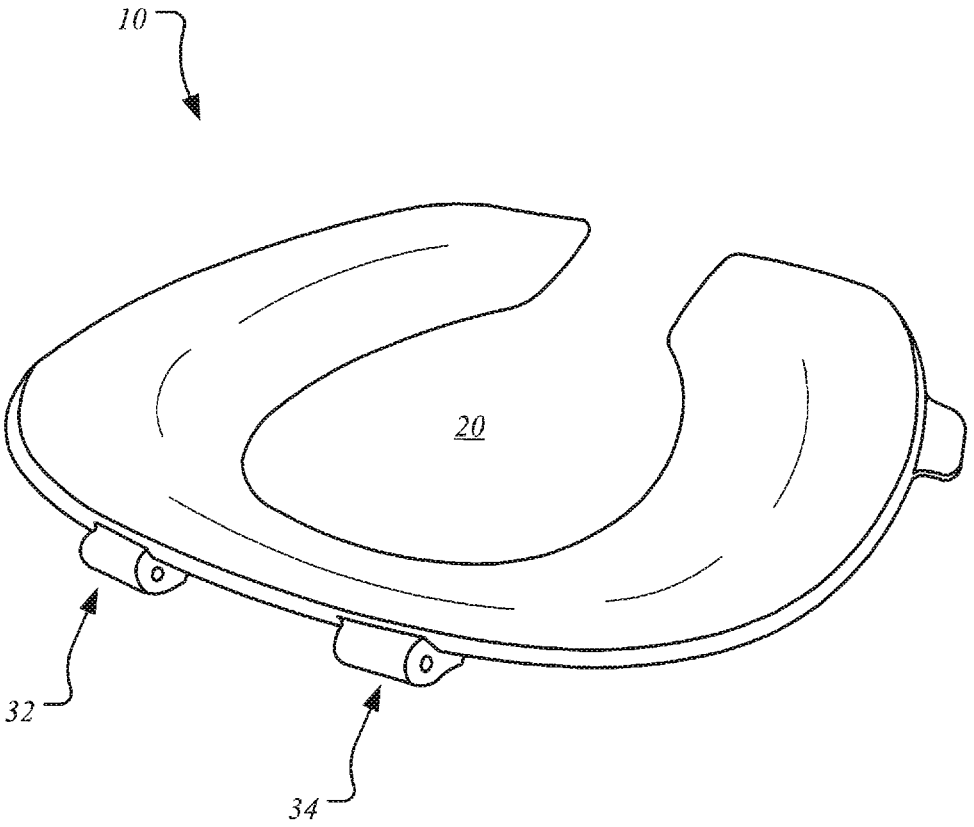
FIG. 3 is a top rear perspective view of the commercial toilet seat.

Referring to FIGS. 2A, 2B and 3, extending above and to the rear of rear section 30 adjacent left section 14 is a left mounting member 34 having a left channel 34L extending into left mounting member 34. Extending above and to the rear of rear section 30 adjacent right section 12 is a right mounting member 32 having a right channel 32R extending into right mounting member 32. The mounting members 32 and 34 and respective channels 34L and 32R are parallel. The distance between the interior surfaces of mounting members 34 and 32 is designed to conform to commercial retaining members on a toilet bowel to enable (a) a left retaining pin or bolt to extend through a channel in a left retaining member and into left channel 34L and similarly, (b) a right retaining pin or bolt to extend through a channel in a right retaining member and into the right channel 32R. In general, this assembly is referred to as a toilet bowl mounting assembly to rotatably mount the commercial toilet seat 10 to a rear top of a toilet bowl. Optionally, the commercial toilet seat 10 may have a cover to cover central arcuate opening 20.

Figure 6:
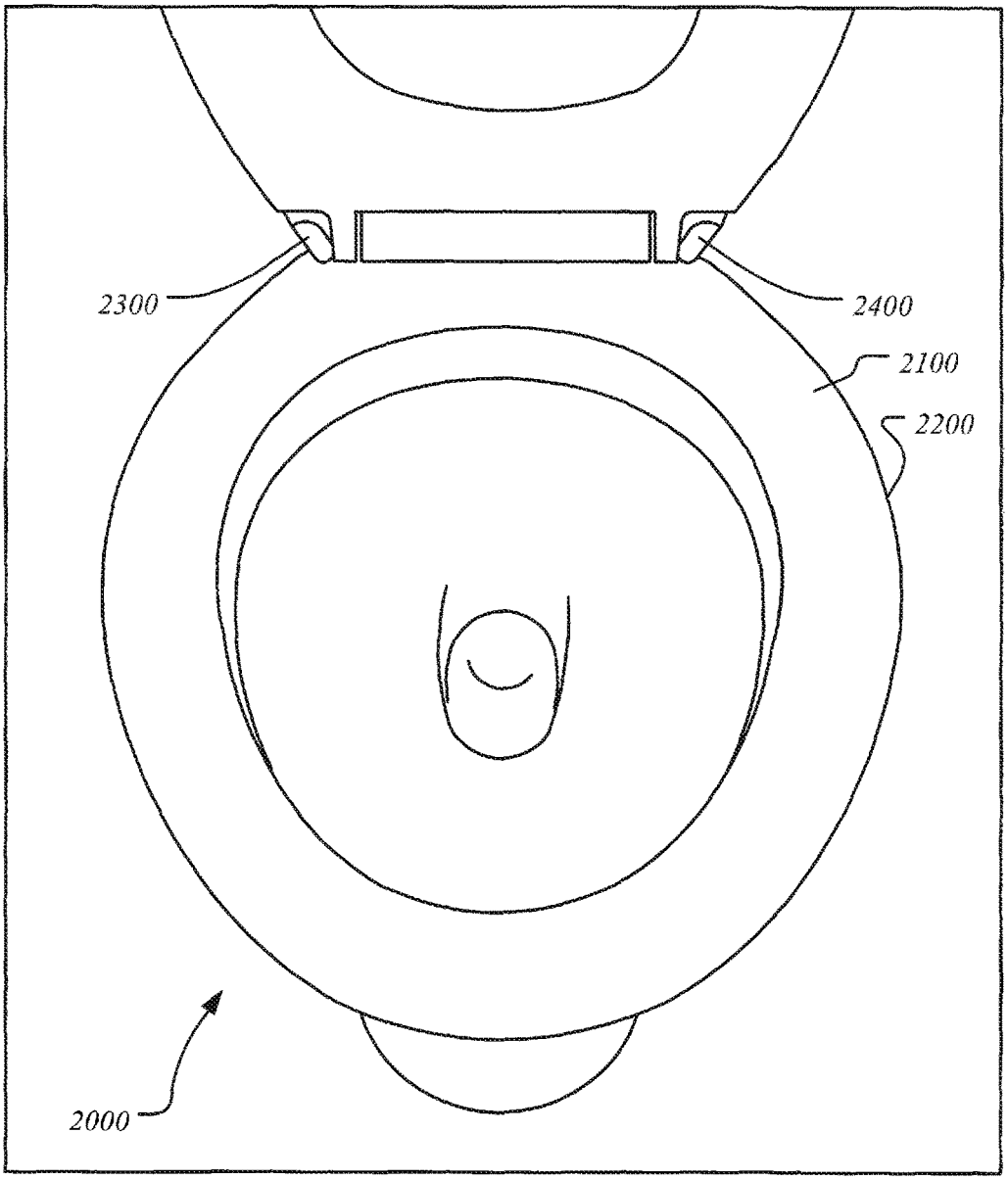
FIG. 6 is an illustration of a commercial toilet bowl with an upper rim.

Referring to FIG. 6, there is illustrated a commercial toilet bowl 2000 with an upper rim 2100 and an exterior circumference 2200. Also illustrated is a left commercial retaining member 2300 to retain left mounting member 34 and a retaining pin (not shown) and a right commercial retaining member 2400 to retain the right mounting member 32 and a retaining pin (not shown).

It will be appreciated that FIG. 6 is shown for reference purposes only for support in the discussion in the text and claims when the present invention is used in conjunction with or adapted for use with a commercial toilet bowl.

Figure 5:
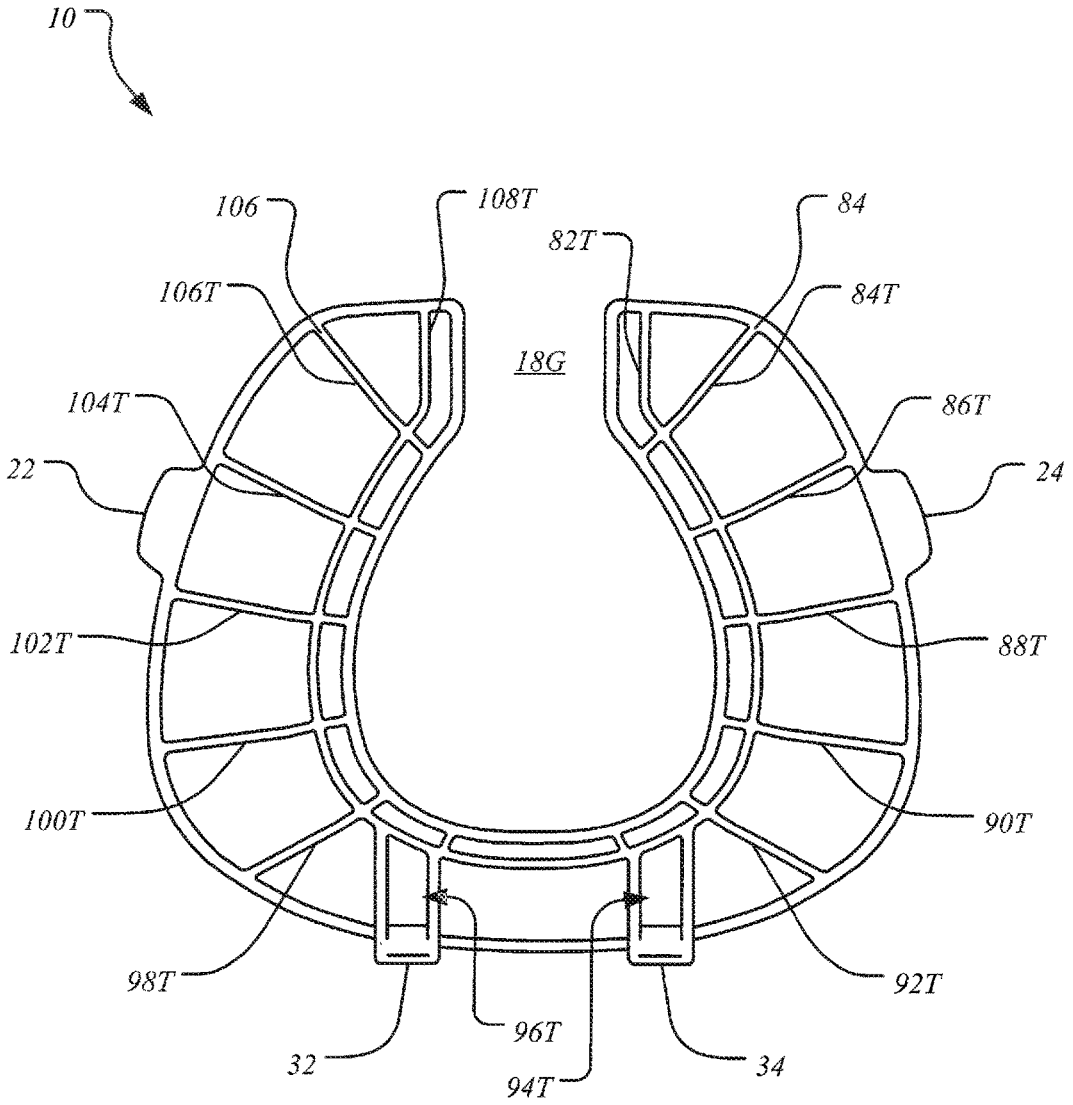
FIG. 5 is a bottom view of the commercial toilet seat with wings and stabilizing members illustrating the two interior partial circumferential walls that form the horizontal section that rests directly on the upper rim of the toilet bowl and the multiplicity of spaced apart stabilizing ribs that intersect the two interior partial circumferential walls, extend in a horizontal direction past the outermost interior partial circumferential wall and then extend at an upward slope until the multiplicity of stabilizing ribs join the outer partial circumferential wall with respective wings extending at a downward slope from opposite sides of the exterior partial circumferential wall.

Referring to FIG. 2A and FIG. 2B, there is illustrated a bottom perspective view of the commercial toilet seat 10 with left wing 24 and right wing 22 and transverse stabilizing members or ribs. Referring to FIG. 5, there is illustrated a bottom plan view of the commercial toilet seat 10 with left wing 24 and right wing 12. Depending on the best visual image, the respective parts are numbered where they are best seen in either FIGS. 2A, 2B and/or FIG. 5.

In both FIG. 2A and FIG. 2B there is illustrated a commercial toilet seat bottom portion 46, having a first interior partial circumferential wall 50 with a first interior partial circumferential bottom surface 52 that partially surrounds the open area 20 and a second interior partial circumferential wall 60 at spaced apart radial distances from the first interior partial circumferential wall 50 with a second interior partial circumferential bottom surface 62. A multiplicity of spaced transverse stabilizing ribs intersect the two interior partial circumferential walls, extend in a horizontal radial direction from the first interior partial circumferential wall 50 past the second interior partial circumferential wall 60 by radial distances, and then the multiplicity of transverse stabilizing ribs begin an upward slope and extend at an upward slope until the multiplicity of spaced apart transverse stabilizing ribs join the exterior partial circumferential wall 70. The respective bottom surfaces 52 and 62 of the two interior partial circumferential walls 50 and 60 and the horizontal portion of the multiplicity of transverse strengthening ribs form the horizontal section that rests directly on the upper rim of the toilet bowl.

Also illustrated in FIGS. 2A and 2B, the multiplicity of spaced apart transverse stabilizing ribs (in FIGS. 2A and 2B, fourteen (14) transverse stabilizing ribs are illustrated by way of example), extend as just discussed, or alternatively described, extend from exterior circumferential wall 70 at a downward slope to radial distances spaced apart from second interior circumferential wall 60 and then extend in a radial and horizontal orientation through second interior circumferential wall 60 to the first interior circumferential wall 50.

As illustrated in FIGS. 2A and 2B, the transverse stabilizing ribs, also identified and referred to through this patent application as multiplicity of strengthening ribs, going clockwise in FIGS. 2A and 2B, are numbered 82, 84, 86, 88, 90, 92, 94, 96, 98, 100, 102, 104, 106 and 108, and have the horizontal flat section that extends from the first inner partial circumferential wall 50 for a radial distance which by way of example is one (1) radial inch past the second interior partial circumferential wall 60. These flat, horizontal sections of the transverse stabilizing ribs sub-numbered 84H, 86H, 88H, 90H, 92H, 94H, 96H, 98H, 100H, 102H, 104H and 106H are also considered to be stabilizing ribs which are a key component of this invention and allow the bottom portion 46 of the commercial toilet seat bowl 10 to be in continuous contact with the upper rim of a toilet bowl. Each transverse stabilizing rib (also called transverse strengthening rib) also has a transition section that extends at an upward sloped angled from approximately one (1) radial inch outside of second partial interior circumferential wall 60 to exterior partial circumferential wall 70. These transition sections taper the transverse ribs upwardly towards the exterior circumferential wall 70. The slope of this transition section is flatter near the center of the commercial toilet seat or near left wing 24 and right wing 22 at an approximate angle of 10 degrees. The transverse strengthening ribs are sub-numbered 82S, 84S 86S, 88S, 90S, 92S, 98S, 100S, 102S, 104S, 106S and 108S (see FIG. 2B). The slope of the transition ribs is steeper (at an approximate angle of 45 degrees) near the front and rear of the toilet seat (transverse strengthening ribs sub-numbered 86S, 88S, 90S, 92S, 98S, 100S, 102S and 104S).

Also illustrated in FIG. 5 are transition points 84T, 86T, 88T, 90T, 92T, 98T, 100T, 102T, 104T, and 106T. These transition points mark the area where the horizontal section of the transverse stabilizing ribs changes from a flat section that fits snugly with the upper rim of the toilet bowl to a transitional section that is tapered to transition upwardly to connect transverse strengthening ribs 82 through 122 to exterior circumferential wall 70. Transition points 82T, 84T, 86T, 88T, 90T, 92T, 100T, 102T, 104T and 106T are illustrated in FIG. 5 and depending upon the location, are approximately one (1) inch outside of the second interior circumferential wall 60 to a smaller distance.

As illustrated in FIG. 5, there are transition points 82T through 108T. These transition points mark the area where the horizontal section of the transverse wall changes from a flat section that fits snugly with the upper rim of the toilet bowl to a transitional section that is tapered to transition upwardly to connect transverse walls 82 through 108 to outer circumferential wall 70. Transition points 84T, 86T, 88T, 90T, 96T, 98T, 100T, 102T, 104T and 106T are illustrated in FIG. 5 approximately one (1) inch outside of middle circumferential wall 60.

A key feature of this invention is the stabilization provided by the horizontal section on the bottom of commercial toilet seat 10 that is in direct contact with the upper rim of the toilet bowl. The horizontal section is formed predominantly from the first interior partial circumferential wall 50, the second interior partial circumferential wall 60, and the horizontal sections of the transverse strengthening ribs sub-numbered 84H, 86H, 88H, 90H, 92H, 94H, 96H, 98H, 100H, 102H, 104H and 106H.

The upwardly sloping strengthening rib sections which are transition sections taper the transverse ribs upwardly towards the exterior circumferential wall 70. The slope of this transition section is flatter near the gap 18G at an approximate angle of 10 degrees (transverse strengthening ribs are sub-numbered 82S and 108S). The slope of the transition ribs is steeper (at an approximate angle of 45 degrees) for the remainder sub-numbered 84S 86S, 88S, 90S and 92S; and after a break, 98S, 100S, 102S 104S and 106S.

Referring to FIG. 3, there is illustrated a top rear perspective view of the commercial toilet seat 10 illustrating opening 20 (also referred to as arcuate opening 20), also illustrating left mounting member 34 and right mounting member 32.

Figure 4:
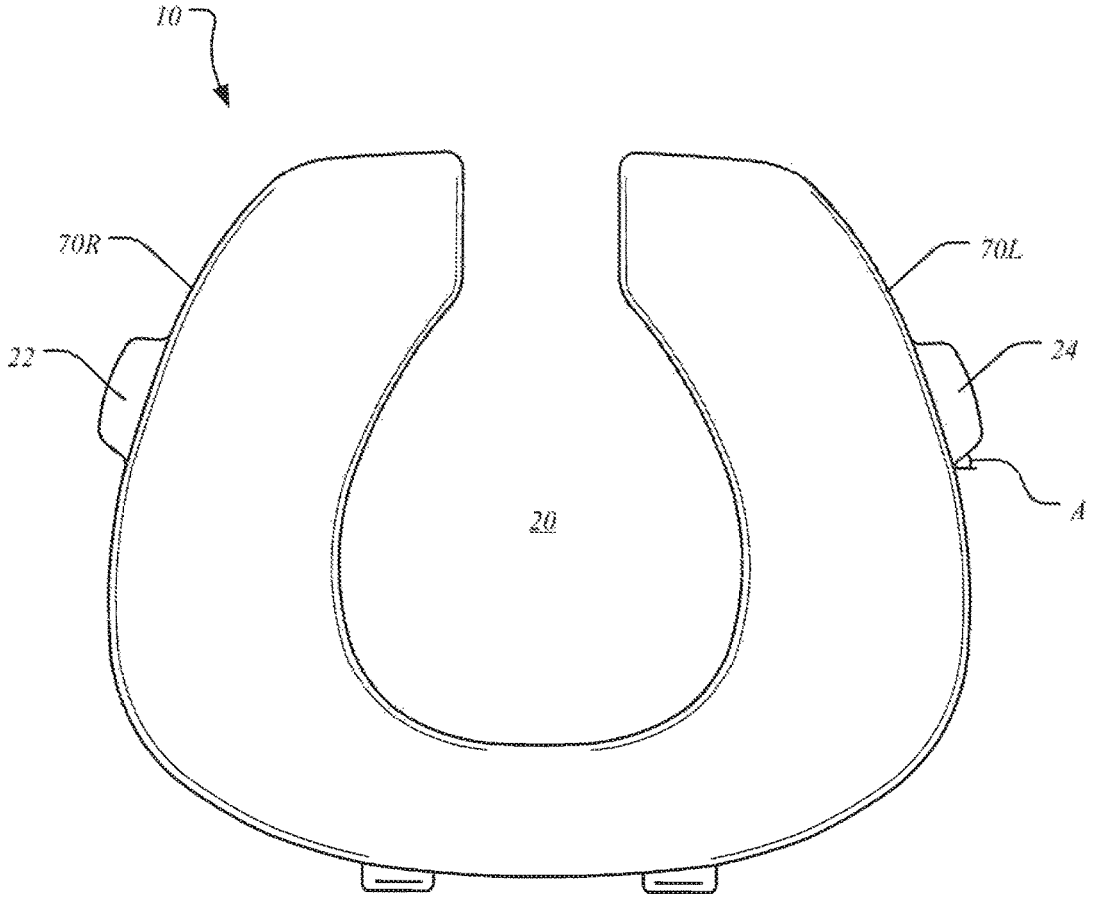
FIG. 4 is a top plan view of the commercial toilet seat.

Referring to FIG. 4, there is illustrated a top plan view of the commercial toilet seat 10 including the opening 20.

Referring to FIG. 4, a left wing 24 extends from an exterior side 70L of exterior circumferential wall 70, and slopes at a downward angle "A", which downward angle ranges from thirty (30) degrees to sixty (60) degrees and preferably forty-five (45) degrees. Similarly, referring to FIG. 1, a right wing 22 extends from an exterior side 70R of exterior circumferential wall 70, and slopes at a downward angle "B", which downward angle ranges from thirty (30) to sixty (60) degrees and preferably forty-five (45) degrees. The wings 24 and 22 extend in opposite downward directions, making it easier to raise and lower the commercial toilet bowl.

For reference purposes, FIG. 6 is an illustration of a commercial toilet bowl 2000 having a upper rim 2100, an exterior circumference 2200, a left commercial retaining member 2300 and a right commercial retaining member 2400.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A toilet seat comprising:

a. a single piece having a top portion and a bottom portion;

b. said top portion including a top surface having a central open area;

c. said bottom portion having a first interior partial circumferential wall with a first interior partial circumferential bottom surface that partially surrounds said central open area and a second interior partial circumferential wall at a spaced apart radial distance from the first interior partial circumferential wall with a second interior circumferential bottom surface, d. a multiplicity of spaced apart transverse stabilizing ribs extending in a radial horizontal direction from the first interior circumferential wall past the second interior circumferential wall by individual radial distances and then extending at an upward slope until each respective multiplicity of spaced apart transverse stabilizing ribs join an exterior circumferential wall, the horizontal portion of said transverse stabilizing ribs and the upwardly sloped portion of said transverse stabilizing ribs positioned below said top section; and e. the respective bottom surfaces of the first and second interior circumferential walls and the horizontal section of said transverse stabilizing ribs forming a stabilizing platform for the toilet seat.

2. The toilet seat in accordance with claim 1, further comprising:

a. a left wing extending from an exterior left side of said exterior circumferential wall, said left wing sloping at a downward angle between thirty (30) degrees and sixty (60) degrees relative to the exterior left side of the exterior partial circumferential wall; and b. a right wing extending from an exterior right side of said exterior circumferential wall, said right wing sloping at a downward angle between thirty (30) degrees and sixty (60) degrees relative to the exterior tight side of the exterior partial circumferential wall.

3. The toilet seat in accordance with claim 1, further comprising:

a. a mounting assembly retaining said toilet seat on said toilet bowl; and b. said mounting assembly including a left mounting member affixed above the rear section and having a left channel extending through the left mounting member and a spaced apart right mounting member affixed above the rear section and having a right channel extending through the right mounting member.

4. A toilet seat adapted for use with a toilet bowl having an upper rim with an exterior circumference, the toilet seat comprising:

a. a single piece having a top portion and a bottom portion;

b. said top portion including a top section having a top surface partially surrounding an open area, the top section configured to extend beyond the exterior circumference of the upper rim of the toilet bowl;

c. said bottom portion having a first interior partial circumferential wall with a first interior circumferential bottom surface that partially surrounds said open area and a second interior partial circumferential wall at a spaced apart radial distance from the first interior partial circumferential wall with a second interior circumferential bottom surface, the respective bottom surfaces of the first and second interior circumferential walls including a horizontal section configured to rest on the upper rim of the toilet bowl when said toilet seat is horizontally aligned;

d. a multiplicity of spaced apart transverse stabilizing ribs extending in a radial horizontal direction from the first interior circumferential wall past the second interior circumferential wall by individual radial distances and then extending at an upward slope until each respective multiplicity of spaced apart transverse stabilizing ribs join an exterior circumferential wall, the upwardly sloped portion of said transverse stabilizing ribs positioned below said top section which extends beyond the exterior circumference of the exterior upper rim of the toilet bowl; and e. a left wing extending from an exterior left side of said exterior circumferential wall and a right wing extending from an exterior right side of said exterior circumferential wall.

5. The toilet seat in accordance with claim 4, further comprising: said top surface is sloped and semi-bowl shape.

6. The toilet seat in accordance with claim 4, further comprising: said toilet seat is made of material selected from the group consisting of polyurethane and reinforced plastic.

7. The toilet seat in accordance with claim 4, further comprising:

a. said left wing sloping at a downward angle between thirty (30) degrees and sixty (60) degrees relative to the exterior left side of the exterior partial circumferential wall; and b. said right wing sloping at a downward angle between thirty (30) degrees and sixty (60) degrees relative to the exterior tight side of the exterior partial circumferential wall.

8. The toilet seat in accordance with claim 4, further comprising: said opening is arcuate in shape.

9. The seer toilet seat in accordance with claim 4, further comprising: a mounting assembly retaining said toilet seat on said toilet bowl.

10. The toilet seat in accordance with claim 9, further comprising: said mounting assembly including a left mounting member affixed above the rear section and having a left channel extending through the left mounting member and a spaced apart right mounting member affixed above the rear section and having a right channel extending through the right mounting member.

11. A toilet seat adapted for use with a toilet bowl having an upper rim with an exterior circumference, the toilet seat comprising:

a. single piece having a top portion and a bottom portion;

b. said top portion including a top section having a top surface and an open area partially surrounded by a combined left section integral with a right section, the left section and the right section are mirror images to each other and form opposite sides of a front section having a gap between the left section and the right section, opposite the front section with the gap, the left section and the right section integrally form a rear section, said top portion configured to extend beyond the exterior circumference of the upper rim of the toilet bowl;

c. said bottom portion having a first interior partial circumferential wall with a first interior partial circumferential bottom surface that partially surrounds said open area and a second interior partial circumferential wall at a spaced apart radial distance from the first interior partial circumferential wall with a second interior partial circumferential bottom surface, the respective bottom surfaces of the first and second interior partial circumferential walls configured to rest directly on the upper rim of the toilet bowl when said toilet seat is horizontally aligned;

d. a multiplicity of spaced apart transverse stabilizing ribs extending in a radial horizontal direction from the first interior partial circumferential wall past the second interior partial circumferential wall by individual radial distances and then extending at an upward slope until each respective multiplicity of spaced apart transverse stabilizing ribs join an exterior partial circumferential wall, the upwardly sloped portion of said transverse stabilizing ribs positioned below said top section which extends beyond the exterior upper rim of the toilet bowl;

e. said first interior partial circumferential wall, said second interior partial circumferential wall, and said horizontal sections of said spaced apart multiplicity of transverse strengthening ribs adapted to be in contact with and stabilized on the upper rim of the toilet bowl;

f. a left wing extending from an exterior left side of a left section of the exterior partial circumferential wall and sloping at a downward angle relative to the exterior left side of the exterior partial circumferential wall, and a right wing extending from an exterior right side of a right section of the exterior partial circumferential wall and sloping at a downward angle relative to the exterior right side of the exterior partial circumferential wall, and g. a mounting assembly retaining said commercial toilet seat on said toilet bowl.

12. The toilet seat in accordance with claim 11, further comprising: said mounting assembly including a left mounting member affixed above the rear section and having a left channel extending through the left mounting member and a spaced apart right mounting member having affixed above the rear section and having a right channel extending through the right mounting member.

13. The toilet seat in accordance with claim 11, further comprising:

said top surface is sloped and semi-bowl shape.

14. The toilet seat in accordance with claim 11, further comprising: said toilet seat is made of material selected from the group consisting of polyurethane and reinforced plastic.

15. The toilet seat in accordance with claim 11, further comprising:

a. said downward angle of said left wing is between thirty (30) degrees and sixty (60) degrees; and b. said downward angle of said right wing is between thirty (30) degrees and sixty (60) degrees.

16. The toilet seat in accordance with claim 11, further comprising: said opening is arcuate in shape.

* * * * *